United States Patent [19]

Edel

[11] 4,290,646

[45] Sep. 22, 1981

[54] INCLINABLE CHAIR

[76] Inventor: Hans J. Edel, Wittekindallee 17, D-4950 Minden, Fed. Rep. of Germany

[21] Appl. No.: 86,612

[22] Filed: Oct. 19, 1979

[30] Foreign Application Priority Data

Oct. 23, 1978 [DE] Fed. Rep. of Germany ..... 2846126

[51] Int. Cl.[3] ..... A47C 1/02

[52] U.S. Cl. ..... 297/327

[58] Field of Search ..... 297/327, 328, 326, 284, 297/313, 361

[56] References Cited

U.S. PATENT DOCUMENTS

| | | | |
|---|---|---|---|
| 185,247 | 12/1876 | Manier | 297/327 |
| 2,122,565 | 7/1938 | Foote | 297/361 |
| 2,638,150 | 5/1953 | May | 297/313 |
| 3,336,079 | 8/1967 | Radke et al. | 297/361 |
| 3,948,558 | 4/1976 | Obermeier | 297/284 |
| 4,155,593 | 5/1979 | Swenson et al. | 297/284 |
| 4,156,544 | 5/1979 | Swenson et al. | 297/284 |
| 4,165,899 | 8/1979 | Goldner | 297/408 |
| 4,190,290 | 2/1980 | Strien | 297/408 |

FOREIGN PATENT DOCUMENTS

| | | | |
|---|---|---|---|
| 1529496 | 11/1966 | Fed. Rep. of Germany | 297/361 |

*Primary Examiner*—Francis K. Zugel

*Attorney, Agent, or Firm*—Pollock, Vande Sande & Priddy

[57] ABSTRACT

An improved inclinable chair structure is disclosed in which a laterally movable lever (6), mounted on the seat frame (4) for easy access from the front, moves along a laterally disposed cam surface (2, 2*a*, 2*b*) which is rigidly secured to the chair base (1).

17 Claims, 4 Drawing Figures

FIG.1
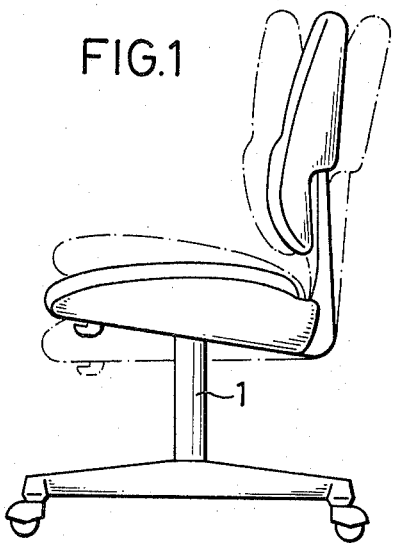
FIG.4
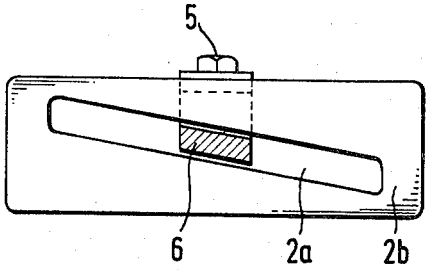
FIG.2
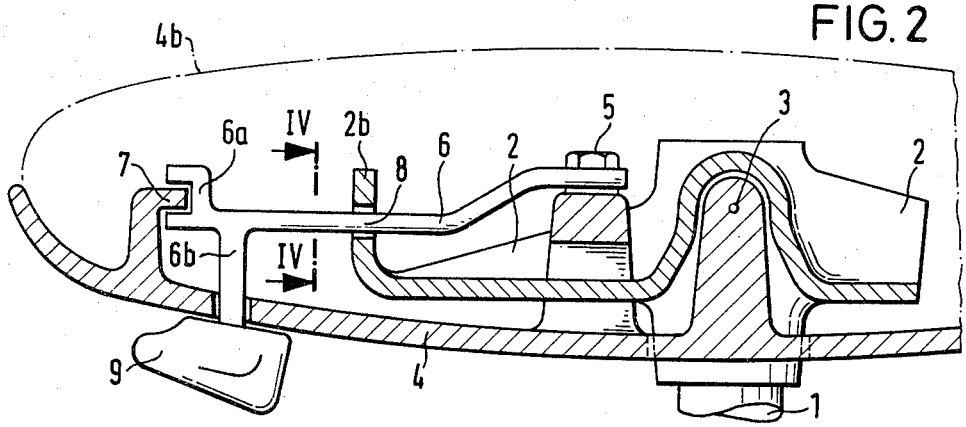
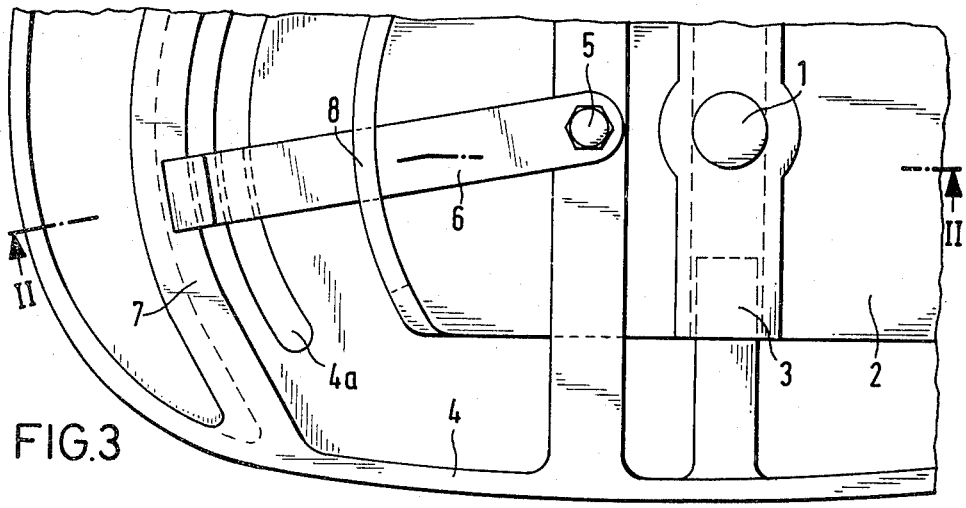
FIG.3

INCLINABLE CHAIR

DESCRIPTION

1. Technical Field

The invention concerns a chair having a seat, a backrest and a support frame, of the type in which the seat can be inclined about a lateral axis relative to the support frame.

2. Background Art

Chairs with inclinable seats are known in various embodiments, both in forms rotatable and non-rotatable with respect to their support frame. They are intended to give the user the possibility of inclining the upper part of the chair in order to adapt both to the special conditions of the place of work and to the personal requirements of the individual.

In one known embodiment, the upper part of the chair is adjustable by means of a pneumatic arrangement. Adjustment by pneumatic means has the advantage of being infinitely variable, but has the disadvantage of being comparatively expensive.

In another known embodiment, adjustment is by means of a vertical screw. Adjustment by screw means is time consuming and has furthermore the disadvantage that one is obliged to leave the chair in order to adjust its position.

Embodiments are also known in which the adjustment of the inclination is achieved by means of mechanical locating segments which give a choice of discrete chair inclinations. Such mechanical locating segments have the disadvantage that an infinitely variable adjustment is not possible.

DISCLOSURE OF THE INVENTION

A primary purpose of the present invention is to provide an inclinable chair in which an infinitely variable adjustment is achieved by means of an inexpensive and reliable adjusting mechanism.

According to a preferred embodiment of the invention, a laterally moveable lever is pivoted to the seat frame in position when operated, to glide along a laterally inclined camming surface rigidly affixed to the support frame of the chair. The camming surface preferably comprises a slot through which the laterally displaceable lever extends and glides. According to a preferred characteristic of the invention, the lever is of rectangular cross-section and is arranged in the slot with the longest sides of the cross-section parallel to the sides of the slot. Effectively, the camming surface or slot is arranged on the support frame in a region extending equidistantly about the pivot axis of the lever. This arrangement ensures that equal movement of the lever in all positions results in equal change in the seat inclination. Preferably, the camming surface also is located about midway between the pivot axis of the lever and a guide surface arranged in the plane of movement of the lever. The guide surface comprises a lip directed towards the pivot axis of the lever and the lever comprises a forked outer end which rides on the lip. The inclusion of the guide surface permits the use of a relatively thin lever and a pivot comprising a simple screw. In a preferred embodiment, the lever is provided with a downwardly directed extension which passes through a slot in the seat frame and has an operating knob on its outer end just beneath the front edge of the seat. It has also proved advantages to coat the contact surfaces of the lever and/or camming surface with a resilient, abrasion resistant material.

Finally, it is suggested according to the invention that the inclination axis of the seat is situated at about the middle of the seat. This results in a particularly favorable center of gravity and in easier control by the lever over the forces of the adjusting mechanism.

Thus with only a few inexpensive parts the construction according to the invention provides the ease of operation that was until now only possible with aid of expensive pneumatic elements. With a simple lateral swing of the knob on the adjusting lever the user is able to set the seat to the desired inclination without having to get up from the chair. The inclination producing couple between the seat or seat frame and the rigid camming surface which is secured to the support frame of the chair, is achieved by means of a single element, namely the lever pivotably secured to the seat frame. Such an arrangement is particularly inexpensive and has the further advantage of being practically without any source of possible defect, such as cannot be ruled out in the case of pneumatic adjustment elements despite their recognized reliability.

BRIEF DESCRIPTION OF THE DRAWING

In the following, a preferred embodiment of the invention will be described in detail with the aid of the drawing in which:

FIG. 1 shows a schematic side view of a chair in various positions of inclination;

FIG. 2 shows a vertical section taken along line II—II in FIG. 3;

FIG. 3 shows a plan view of the adjusting mechanism according to FIG. 2, with the seat cushion removed; and FIG. 4 shows a section taken along line IV—IV in FIG. 2.

BEST MODE FOR CARRYING OUT THE INVENTION

Referring to FIGS. 2 and 3, the support frame for the chair is seen to comprise an inclination plate 2 secured to a column 1. A seat frame 4 is pivotably connected for rotation about a horizontal axis by bearings 3 located on each side of seat frame 4. Bearings 3 are located essentially at the center of seat frame 4, measured front to back. On a central, vertical axis in seat frame 4, a bearing comprising essentially a screw 5 is provided as the pivot axis of a laterally moveable lever 6. Lever 6 includes a forked end **6*a* which rides along a lip 7 extending upwardly from seat frame 4. Lip 7 preferably is directed toward pivot 5 and arranged equidistant therefrom throughout its length. Of course, forked end 6*a* and lip 7 also could be arranged to face oppositely, if desired. Lever 6 passes through a laterally extending, inclined slot 2*a* provided in an upwardly extending front wall 2*b* of inclination plate 2. Front wall 2*b* extends along an arc equidistant from pivot axis 5. While inclination plate 2 is not tiltable, it may be rotatably connected to column 1** of the chair.

The lever 6 therefore is mounted at one end on pivot axis 5 and at the other end on guide lip 7, which essentially constrains lever 6 to movement in a single plane. Below forked end **6*a* extends an operating arm 6*b* to which a knob 9 is attached. Operating arm 6*b* extends through a slot 4*a* in seat frame 4, slot 4*a* also forming an arc about pivot axis 5. The seat cushion is indicated merely by the dot-dash line 4*b* in FIG. 2**.

When lever 6 is moved horizontally, seat frame 4 is inclined forwards or backwards about bearings 3. The degree of inclination depends in the first place on the distance of slot 2*a* from pivot axis 5. In the illustrated embodiment, the slot 2*a* lies about midway between the guide surface formed by lip 7 and pivot axis 5.

In order to obtain a play-free construction of the cooperating parts, they are coated with an abrasive resistant, resilient material such as Nylon or Teflon, or the like, not shown in the illustrations. The coating is provided on forked end 6*a* of lever 6 and on lip 7 with which it cooperates. A similar coating is provided in slot 2*a* and on the region 8 of lever 6 which glides in the slot.

Industrial Applicability

The invention is particularly suited for use in inclinable chairs for office and commercial use; however, its principles may also be applied to domestic furniture where inclination is desired. The scope of the invention is to be limited only by the appended claims.

Having described my invention in sufficient detail to enable others to make and use it, I claim:

1. An improved inclinable chair, comprising:

a support frame;

a seat frame pivotably supported by said support frame for inclination about a horizontal axis;

laterally movable lever means pivotably mounted on said seat frame; and cam means comprising a laterally extending inclined slot mounted on said support frame in position for said lever means to extend through said slot, for causing said inclination of said seat frame to occur as said lever means moves with respect to said slot.

2. A chair according to claim 1, wherein said seat frame comprises guide means contacted by said lever means for constraining at least a portion of said lever means to a single plane during movement.

3. A chair according to claim 1, wherein said lever means is of rectangular cross-section, the longer sides thereof being arranged in parallel to said laterally extending, inclined slot.

4. A chair according to claim 1, wherein said laterally extending, inclined slot extends equidistantly about the pivot axis of said lever means.

5. A chair according to claim 2, wherein said guide means comprises a lip extending toward the pivot axis of said lever means, further comprising a forked portion on said lever means which extends over said lip.

6. A chair according to claim 2, wherein said laterally extending, inclined slot is located approximately midway between the pivot axis of said lever means and said guide means.

7. A chair according to claim 2, wherein the contact surfaces of said lever means with said cam means and said guide means are coated with a resilient, abrasion resistant material.

8. A chair according to claim 5, further comprising a downwardly extending portion of said lever means, a slot in said seat frame through which said downwardly extending portion extends, and a knob on the outer end of the downwardly projecting portion.

9. A chair according to claim 8, wherein said knob is situated beneath the front edge of said seat frame.

10. A chair according to claim 9, wherein said lever means is of rectangular cross-section, the longer sides thereof being arranged in parallel to said laterally extending, inclined slot.

11. A chair according to claim 10, wherein said laterally extending, inclined slot is located approximately midway between the pivot axis of said lever means and said guide means.

12. A chair according to claim 11, wherein the contact surfaces of said lever means with said cam means and said guide means are coated with a resilient, abrasion resistant material.

13. A chair according to claim 12, wherein said laterally extending, inclined slot extends equidistantly about the pivot axis of said lever means.

14. A chair according to claim 13, wherein the axis of inclination of said seat frame is located at approximately the center of said seat frame.

15. A chair according to claim 1, further comprising a downwardly extending portion of said lever means, a slot in said seat frame through which said downwardly extending portion extends, and a knob on the outer end of said downwardly projecting portion.

16. A chair according to claim 15, wherein said knob is situated beneath the front edge of said seat frame.

17. A chair according to claim 1, wherein the axis of inclination of said seat frame is located at approximately the center of said seat frame.

* * * * *